US008039191B2

(12) United States Patent
Eida

(10) Patent No.: US 8,039,191 B2
(45) Date of Patent: Oct. 18, 2011

(54) TONER

(75) Inventor: Akihiro Eida, Wakayama (JP)

(73) Assignee: Kao Corporation, Tokyo (JP)

( * ) Notice: Subject to any disclaimer, the term of this patent is extended or adjusted under 35 U.S.C. 154(b) by 890 days.

(21) Appl. No.: 11/758,856

(22) Filed: Jun. 6, 2007

(65) Prior Publication Data

US 2007/0287090 A1 Dec. 13, 2007

(30) Foreign Application Priority Data

Jun. 9, 2006 (JP) ..... 2006-160555

(51) Int. Cl.
*G03G 9/08* (2006.01)

(52) U.S. Cl. ..... 430/137.18; 430/137.19; 430/137.2

(58) Field of Classification Search ..... 430/137.18, 430/137.19, 137.2
See application file for complete search history.

(56) References Cited

U.S. PATENT DOCUMENTS

| | | | | |
|---|---|---|---|---|
| 4,842,974 | A * | 6/1989 | Landa et al. | 430/137.19 |
| 5,639,584 | A * | 6/1997 | Anno et al. | 430/137.18 |
| 5,747,211 | A * | 5/1998 | Hagi et al. | 430/108.6 |
| 5,863,692 | A * | 1/1999 | Nakamura et al. | 430/108.4 |
| 6,203,955 | B1 * | 3/2001 | Mochizuki | 430/108.6 |
| 6,326,119 | B1 * | 12/2001 | Hollenbaugh et al. | 430/137.2 |
| 7,144,668 | B2 | 12/2006 | Baba et al. | |
| 2003/0162113 | A1 * | 8/2003 | Ito | 430/108.6 |
| 2004/0185367 | A1 * | 9/2004 | Serizawa et al. | 430/124 |
| 2005/0233237 | A1 | 10/2005 | Eida et al. | |
| 2006/0093942 | A1 * | 5/2006 | Eida | 430/108.7 |

FOREIGN PATENT DOCUMENTS

| | | |
|---|---|---|
| JP | 2003-215838 | 7/2003 |
| JP | 2004-126005 | 4/2004 |
| JP | 2004-295101 | 10/2004 |
| JP | 2005-195694 | 7/2005 |
| JP | 2005-326840 | 11/2005 |
| JP | 2006-30263 | 2/2006 |
| JP | 2006-126587 | 5/2006 |

OTHER PUBLICATIONS

U.S. Appl. No. 12/273,073, filed Nov. 18, 2008, Eida et al.
U.S. Appl. No. 12/826,797, filed Jun. 30, 2010, Eida et al.

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

A toner having a BET specific surface area of from 1.5 to 3.5 $m^2/g$, obtainable by a process including the steps of; step (1): pulverizing a toner composition containing at least a resin binder and a colorant in the presence of fine inorganic particles having an average primary particle size of from 6 to 20 nm to obtain mother toner particles having a volume-median particle size of from 3 to 8 μm; and step (2): externally adding silica having an average primary particle size of from 25 to 60 nm to the mother toner particles obtained in the above step (1). The toner of the present invention is suitably used for, for example, developing a latent image formed in electrophotography, electrostatic recording method, electrostatic printing method, or the like.

12 Claims, No Drawings

TONER

FIELD OF THE INVENTION

The present invention relates to a toner used for, for example, developing a latent image formed in electrophotography, electrostatic recording method, electrostatic printing method, or the like.

BACKGROUND OF THE INVENTION

In the formation of full-color fixed images, since four colors of toners are usually used, the influence of an external additive freed from the toner on an organic photoconductor (OPC) or the like is big, and background fog is likely to be generated under high-temperature and high-humidity, so that degradation of the fixed images is likely to be caused, as compared to the development using only one color of a toner. Therefore, it has been proposed that the external additive is solidly adhered to a toner surface. For example, JP2004-126005 A proposes a method of carrying out the surface treatment with the external additive on a toner of which a BET specific surface area or the like is specified, and JP2003-215838 A proposes a method of fixing the external additive under compressed shearing stress conditions.

SUMMARY OF THE INVENTION

The present invention relates to a toner having a BET specific surface area of from 1.5 to 3.5 $m^2/g$, obtainable by a process including the steps of;

step (1): pulverizing a toner composition containing at least a resin binder and a colorant in the presence of fine inorganic particles having an average primary particle size of from 6 to 20 nm to obtain mother toner particles having a volume-median particle size of from 3 to 8 μm; and step (2): externally adding silica having an average primary particle size of from 25 to 60 nm to the mother toner particles obtained in the above step (1).

DETAILED DESCRIPTION OF THE INVENTION

The present invention relates to a toner, wherein filming to an organic photoconductor and the generation of background fog under environmental conditions of high-temperature and high-humidity by a release of an external additive are reduced, and a process for preparing the toner.

The toner of the present invention exhibits an excellent effect that filming to an organic photoconductor and the generation of background fog under environmental conditions of high-temperature and high-humidity by a release of an external additive are reduced.

These and other advantages of the present invention will be apparent from the following description.

A method of JP2004-126005 A is simply adjusting the particle size and the amount of silica to be externally added to a toner, so that a degree of freedom in the designing of a toner is small. In addition, a method of JP2003-215838 A requires a time of 15 minutes for the external addition, so that the worsening of the productivity is a disadvantage.

The toner of the present invention is characterized in that a toner is obtainable by a process including the steps of; step (1): pulverizing a toner composition containing at least a resin binder and a colorant in the presence of fine inorganic particles having an average primary particle size of from 6 to 20 nm to obtain mother toner particles having a volume-median particle size of from 3 to 8 μm; and step (2): externally adding silica having an average primary particle size of from 25 to 60 nm to the mother toner particles obtained in the above step (1), and has a BET specific surface area of from 1.5 to 3.5 $m^2/g$.

In the step (1), the fine inorganic particles having an average primary particle size of from 6 to 20 nm which are easy to self-aggregate are allowed to exist during pulverizing the toner composition, and whereby self-aggregation is suppressed, and the fine inorganic particles can be adhered to the surface of the mother toner particles. In addition, in the step (2), the silica is further externally added to the mother toner particles obtained in the above step (1), and whereby an external additive in addition to the fine inorganic particles added to the mother toner particles in the step (1) can be further adhered to the surface of the toner particles. Consequently, the fine inorganic particles and the silica are adhered to the toner obtainable via the steps (1) and (2). Further, the fine inorganic particles which did not adhere to the mother toner particles during the pulverization of the step (1) are collected, and whereby free fine inorganic particles can be reduced, especially free silica can be reduced when the silica was used as the fine inorganic particles. In addition, it can be considered that the silica having relatively moderate self-aggregation property and an average primary particle size of from 25 to 60 nm is externally added to the mother toner particles after pulverizing the toner composition, and whereby the toner of the present invention exhibits a spacer effect on the toner surface, so that OPC filming is improved. The silica having an average primary particle size of from 25 to 60 nm has a specific surface area smaller than that of fine inorganic particles such as silica having small particle sizes of an average primary particle size of from 6 to 20 nm. Therefore, an effect that the BET specific surface area of the toner would not be greatly changed even when the silica is externally added to the mother toner particles according to a usual method can be also obtained.

Specifically, the toner of the present invention obtainable via the above-mentioned steps has a specified BET specific surface area, and has a constitution that the fine inorganic particles having an average primary particle size of from 6 to 20 nm solidly adhere to the surface of the mother toner particles, and the silica having an average primary particle size of from 25 to 60 nm further adheres to the surface of the mother toner particles. Among them, it is presumed that the fine inorganic particles having an average primary particle size of from 6 to 20 nm adhere to the surface of the mother toner particles undergoing the pulverization force of a pulverizer or the like, thereby even more solidly adhering to the mother toner particles. In addition, the toner of the present invention has less free external additive.

Therefore, the toner of the present invention obtainable via the above steps has the above constitution in which the fine inorganic particles and the silica adhere to the surface of the mother toner particles, and the BET specific surface area is properly adjusted, whereby charging stability by environment is improved, and the generation of background fog under environmental conditions of high-temperature and high-humidity is also suppressed. A BET specific surface area is cited as a value representing properties of the toner. The BET specific surface area is the value determined by a particle size and particle size distribution of the toner, a particle size and particle size distribution of the external additive, the amount of the external additive, the amount of a hydrophobic treatment with the external additive, adhesion condition of the external additive to the toner, and the like, and is characterized in that the value can represent adhesion condition of the silica to the toner. In the toner of the present invention, when the BET specific surface area is higher than the proper value, it shows that adhesion strength of the external additive to the toner is not sufficient, or the amount of the external additive is excessive, so that durability and background fog under environmental conditions of high-temperature and high-humidity get worse. In addition, when the BET specific surface area is lower than the proper value, it shows that adhesion of the external additive is low, or embedment of the external additive in the toner surface is excessive, so that the worsening of fluidity or the like is caused. The adjustment of the BET specific surface area to the proper value can be achieved by adjusting the pulverizing method and condition on the step (1), and the amount of silica in the step (2), or the like. For example, a high BET specific surface area can be achieved by an increase in the amount of the fine inorganic particles, a reduction in a pulverizing pressure, weakening the degree of a lower limit cut-off classification, or the like in the step (1), and by an increase in the amount of the externally added silica, a reduction in strength of the external addition, or the like in the step (2).

The toner of the present invention has a BET specific surface area of from 1.5 to 3.5 $m^2/g$, preferably from 1.8 to 3.5 $m^2/g$, and more preferably from 2.0 to 3.0 $m^2/g$, from the viewpoint of satisfying both fluidity and chargeability. In the present specification, a BET specific surface area is determined according to the method described in Examples set forth below.

The step (1) is a step of pulverizing a toner composition containing at least a resin binder and a colorant in the presence of fine inorganic particles having an average primary particle size of from 6 to 20 nm to obtain mother toner particles having a volume-median particle size of from 3 to 8 μm.

The fine inorganic particles have an average primary particle size of from 6 to 20 nm, preferably from 8 to 20 nm, and more preferably from 8 to 16 nm, from the viewpoint of preventing excessive embedment. In the present specification, an average primary particle size of the fine inorganic particles is determined according to the method described in Examples set forth below. The fine inorganic particles can be used in admixture of two or more kinds of particles. When two or more kinds of the fine inorganic particles are combined, it is preferable that all the fine inorganic particles combined have an average primary particle size within the above-mentioned range.

The fine inorganic particles include an inorganic oxide or the like selected from the group consisting of silica, titania, alumina, zinc oxide, magnesium oxide, cerium oxide, iron oxide, copper oxide, and tin oxide. These can be used alone or in admixture of two or more kinds. Among them, silica having a relatively small specific gravity in these fine inorganic particles is preferable, from the viewpoint of uniform adhesion to the toner during the pulverization.

As the silica, those prepared by a known method can be used. Those prepared by dry method or high-temperature hydrolysis method are preferable from the viewpoint of dispersibility of the silica. In addition, besides anhydrous silica, the silica may contain aluminum silicate, sodium silicate, potassium silicate, magnesium silicate, zinc silicate, or the like. $SiO_2$ is contained in the silica preferably in an amount of 80% by weight or more, and more preferably in an amount of 85% by weight or more.

The surface of the fine inorganic particles may be subjected to hydrophobic treatment, and it is preferable that the silica is treated with a hydrophobic treatment agent. The hydrophobic treatment method is not particularly limited. The hydrophobic treatment agent includes silane coupling agents such as hexamethyl disilazane (HMDS) and dimethyl dichlorosilane (DMDS); silicone oil treatment agents such as dimethyl silicone oil and amino-modified silicone oil; and the like. Among them, silane coupling agents are preferable. It is preferable that the fine inorganic particles are treated with the hydrophobic treatment agent in an amount of preferably from 1 to 7 $mg/m^2$ per a BET specific surface area of the fine inorganic particles.

In addition, it is preferable that the fine inorganic particles are a mixture of positively charged fine particles and negatively charged fine particles. The mixture of positively charged fine particles and negatively charged fine particles is used in the step (1), and whereby an excessive charge of the fine inorganic particles in a pulverizer is suppressed, and the dispersion of the fine inorganic particles is improved. Therefore, more uniform adhesion to the toner surface can be provided.

The term "negatively charged fine particles" refers to particles showing a negative charge when the fine inorganic particles and iron powder are subjected to triboelectric charging, and the term "positively charged fine particles" refers to particles showing a positive charge when the fine inorganic particles and iron powder are subjected to triboelectric charging. The charge of the fine inorganic particles is determined with a blowoff-type charge measuring apparatus. The charge of the negatively charged fine particles is preferably from −10 to −500 μC/g, and more preferably from −20 to −400 μC/g. In addition, the charge of the positively charged fine particles is preferably from 10 to 500 μC/g, and more preferably from 20 to 400 μC/g.

The charge of the fine inorganic particles can be adjusted, for example, by hydrophobic treatment of the fine inorganic particles.

The hydrophobic treatment agent to obtain the negatively charged fine particles is not particularly limited, and includes silane coupling agents such as hexamethyl disilazane (HMDS), dimethyl dichlorosilane (DMDS), isobutyl trimethoxysilane, and octyl silane; silicone oil treatment agents such as dimethyl silicone oil; and the like.

As the negatively charged fine particles, those commercially available can be used. The preferred commercially available products of silica treated with HMDS include H3004, H2000, HDK H30™, HDK H20TM, HDK H13™ (hereinabove commercially available from Wacker Chemicals), TS530 (hereinabove commercially available from Cabot Corporation), RX300, RX200 (hereinabove commercially available from Nippon Aerosil), and the like. The preferred commercially available products of silica treated with DMDS include R976, R974, R972 (hereinabove commercially available from Nippon Aerosil), and the like. The preferred commercially available products of silica treated with silicone oil include HDK H30TD, HDK H20TD, HDK H13TD (hereinabove commercially available from Wacker Chemicals), TS720 (hereinabove commercially available from Cabot Corporation), and the like. The preferred commercially available products of silica treated with a mixture of HMDS and silicone oil include HDK H30TX, HDK H20TX, HDK H13TX (hereinabove commercially available from Wacker Chemicals), and the like. The preferred commercially available products of titania treated with isobutyl trimethoxysilane include JMT-150IB (hereinabove commercially available from Tayca), and the like.

The hydrophobic treatment agent to obtain the positively charged fine particles is not particularly limited, and includes aminosilane; silicone oil treatment agents such as amino-modified silicone oil and epoxy-modified silicone oil; and the like. Among them, the amino-modified silicone oil is preferable, from the viewpoint of environmental stability of the charge.

As the positively charged fine particles, those commercially available can be used. The preferred commercially available products of silica treated with amino-modified silicone oil include HVK2150, HDK3050, HDK H30TA, HDK H13TA (commercially available from Wacker Chemicals), and the like.

The mixing of the positively charged fine particles and the negatively charged fine particles may be carried out either previously or in a pulverizer. In addition, the feeding of the positively charged fine particles and the negatively charged fine particles to a pulverizer is not necessarily carried out at the same time, and may be separately carried out. It is preferable that the mixing is previously carried out, and thereafter the mixture is fed to a pulverizer at the same time, from the viewpoint of preventing the fine particles from being aggregated to each other.

As the combination of the positively charged fine particles and the negatively charged fine particles, a positively charged silica and a negatively charged silica are preferable from the viewpoint of ensuring fluidity in a pulverizer.

The weight ratio of the positively charged fine particles and the negatively charged fine particles used (positively charged fine particles/negatively charged fine particles) is preferably from 99/1 to 70/30, and more preferably from 97/3 to 80/20 when the obtainable toner is the positively charged toner, and the weight ratio is preferably from 1/99 to 30/70, and more preferably from 3/97 to 20/80 when the obtainable toner is the negatively charged toner, from the viewpoint of controlling chargeability.

The fine inorganic particles are used in the step (1) in an amount of preferably from 1.5 to 8 parts by weight, more preferably from 2 to 8 parts by weight, even more preferably from 3 to 8 parts by weight, and even more preferably from 4 to 7 parts by weight, based on 100 parts by weight of the toner composition, from the viewpoint of satisfying both fluidity and durability.

Not all the amount of the fine inorganic particles used in the step (1) necessarily adheres to the obtainable mother toner particles. The ratio of adhesion varies depending upon a pulverizer used in the step (1) or the operating conditions thereof. When the fine inorganic particles are used in the step (1) in an amount of 10 parts by weight or less or so, based on 100 parts by weight of the toner composition, the amount of adhesion is increased in proportion to the amount used. In addition, under usual pulverization conditions which one skilled in the art employs on a general pulverization, the ratio of the amount of adhering to the surface of the mother toner particles is from 50 to 80% by weight or so, based on all the amount of the fine inorganic particles used.

The resin binder contained in the toner composition includes polyesters, polyester amides, epoxy resins, polycarbonates, polyurethanes, styrene-acrylic resins, composite resins obtainable by using raw material monomers for polycondensation resins and raw material monomers for addition polymerization resins, and the like, without being particularly limited thereto. Among them, from the viewpoint of dispersibility of the colorant and transferability, the polyester and the composite resin having a polyester component and an addition polymerization resin component such as a vinyl resin are preferable, and the polyester is more preferable. The polyester is contained in an amount of preferably from 50 to 100% by weight, more preferably from 80 to 100% by weight, and even more preferably substantially 100% by weight, of the resin binder.

Here, the composite resins may be resins (hybrid resins) obtainable by using, in addition to the raw material monomers for polycondensation resins and the raw material monomers for addition polymerization resins, compounds (dual-reactive monomers) which can react with both the raw material monomers for polycondensation resins and the raw material monomers for addition polymerization resins.

The polyester can be obtained by polycondensation of the raw material monomers containing an alcohol component containing dihydric or higher polyhydric alcohols, and a carboxylic acid component containing dicarboxylic or higher polycarboxylic acid compounds.

The dihydric alcohols include an alkylene (2 or 3 carbon atoms) oxide adduct (average number of moles: 1 to 10) of bisphenol A such as polyoxypropylene-2,2-bis(4-hydroxyphenyl)propane and polyoxyethylene-2,2-bis(4-hydroxyphenyl)propane, ethylene glycol, propylene glycol, 1,6-hexanediol, bisphenol A, hydrogenated bisphenol A, and the like.

The trihydric or higher polyhydric alcohols include sorbitol, 1,4-sorbitan, pentaerythritol, glycerol, trimethylolpropane, and the like.

In addition, the dicarboxylic acid compounds include dicarboxylic acids such as phthalic acid, isophthalic acid, terephthalic acid, fumaric acid, and maleic acid; a substituted succinic acid of which substituent is an alkyl group having 1 to 20 carbon atoms or an alkenyl group having 2 to 20 carbon atoms; acid anhydrides thereof; alkyl (1 to 12 carbon atoms) esters thereof; and the like.

The tricarboxylic or higher polycarboxylic acid compounds include 1,2,4-benzenetricarboxylic acid (trimellitic acid), acid anhydrides thereof, alkyl (1 to 12 carbon atoms) esters thereof, and the like.

Here, the alcohol component may properly contain a monohydric alcohol, and the carboxylic acid component may properly contain a monocarboxylic acid compound, from the viewpoint of adjusting the molecular weight and improving offset resistance.

The polyester can be prepared by, for example, polycondensation of the alcohol component and the carboxylic acid component at a temperature of from 180° to 250° C. in an inert gas atmosphere, further under reduced pressure, and using an esterification catalyst as desired.

The polyester has a softening point of preferably from 90° to 150° C., and more preferably from 95° to 130° C., from the viewpoint of fixing ability and durability, and a glass transition temperature of preferably from 50° to 85° C. In addition, the polyester has an acid value of preferably from 0.1 to 35 mgKOH/g, and a hydroxyl value of preferably from 5 to 50 mgKOH/g.

As the colorant contained in the toner composition, dyes, pigments, and the like which are used as colorants for a toner can be used. The colorant includes Phthalocyanine Blue, Permanent Brown FG, Brilliant Fast Scarlet, Pigment Green B, Rhodamine-B Base, Solvent Red 49, Solvent Red 146, Solvent Blue 35, quinacridone, Carmine 6B, disazoyellow, and the like. These colorants can be used alone or in admixture of two or more kinds. The colorant is contained in an amount of preferably from 1 to 40 parts by weight, and more preferably from 2 to 10 parts by weight, based on 100 parts by weight of the resin binder.

Further, the toner composition may properly contain an additive such as a releasing agent, a charge control agent, a magnetic powder, a fluidity improver, an electric conductivity modifier, an extender, a reinforcing filler such as a fibrous substance, an antioxidant, an anti-aging agent, or a cleanability improver.

It is preferable that the toner composition is a melt-kneaded product obtainable by melt-kneading the raw materials for the toner containing the above-mentioned resin binder, colorant, and the like. Here, it is preferable that the raw materials for the toner are pre-mixed with a Henschel mixer or the like, and the mixture is subjected to the melt-kneading.

The melt-kneading of the toner composition can be carried out with a closed type kneader, a single-screw or twin-screw extruder, an open-roller type kneader or the like. Among them, an open-roller type kneader is preferable. The colorants can be efficiently obtained in high dispersion with the open-roller type kneader, without a repeat of the kneading or without a dispersion aid.

The open-roller type kneader usable in the present invention has plural feeding ports and a discharging outlet for a kneaded product provided along an axial direction of the roller.

An open-roller type kneader refers to a kneader of which melt-kneading member is an open type, and can easily dissipate the kneading heat generated during the melt-kneading. In addition, it is desired that the open-roller type kneader usable in the present invention is a kneader containing at least two rollers, and preferably two rollers of a heat roller and a cooling roller.

Structures, sizes, materials and the like of the roller are not particularly limited. Also, the roller surface may be any of smooth, wavy, rugged or other surfaces. In order to increase kneading share, it is preferable that plural spiral ditches are engraved on the surface of each roller.

The temperature of the roller can be adjusted by, for example, the temperature of a heating medium passing through the inner portion of the roller, and each roller may be divided in two or more portions in the inner portion of the roller, each being communicated with heating media of different temperatures.

It is preferable that the temperature at the heat roller, especially the feeding side of the heat roller, is higher than both the softening point of the resin binder and the melting point of the releasing agent, more preferably a temperature calculated from the temperature higher than the higher of the softening point of the resin binder and the melting point of the releasing agent plus 0° to 80° C., and even more preferably a temperature calculated from the temperature plus 5° to 50° C. Here, in the preparation of the toner containing the plural resin binders, the softening point of the resin binder refers to a softening point obtained by multiplying the softening point of each of the resin binders by the weight ratio and summating these multiplied numbers. In addition, it is preferable that the temperature at the cooling roller, especially the feeding side of the cooling roller, is lower than the softening point of the resin binder.

The number of rotation of the heat roller, i.e. the peripheral speed of the heat roller, is preferably from 2 to 100 m/min. The peripheral speed of the cooling roller is preferably from 2 to 100 m/min, more preferably from 10 to 60 m/min, and even more preferably 15 to 50 m/min. In addition, it is preferable that the two rollers have different peripheral speeds from each other, and that the ratio of the peripheral speed of the two rollers (cooling roller/heat roller) is preferably from 1/10 to 9/10, and more preferably from 3/10 to 8/10.

It is preferable that the pulverization of the toner composition is carried out by the method including the steps of carrying out the rough pulverization, and thereafter carrying out the fine pulverization. The toner composition can be directly finely pulverized. The fine inorganic particles may be allowed to exist in either pulverizing step of the rough pulverization or the fine pulverization. It is preferable that the finely pulverizing step is carried out in the presence of the fine inorganic particles. In the rough pulverization, it is preferable that the toner composition are pulverized to a size so that a volume-median particle size ($D_{50}$) of the resulting roughly pulverized product is 1000 μm or less, and more preferably from 70 to 500 μm.

The step of roughly pulverizing the toner composition can be carried out with Atomizer, Rotoplex, or the like.

The pulverizer used in the finely pulverizing step includes a jet type pulverizer such as a fluidized-bed type jet mill or a gas stream type jet mill; a mechanical pulverizer such as a turbo mill; and the like. A jet type pulverizer is preferable from the viewpoint of pulverizability.

Here, it is preferable that particles having a large particle size in the toner composition after the fine pulverization are selected according to an upper limit cut-off classification and the selected particles are pulverized again.

The fluidized-bed jet mill preferably usable in the present invention includes the "TFG" Series commercially available from Hosokawa Micron Corporation, the "AFG" Series commercially available from Hosokawa Micron Corporation, and the like.

In addition, the gas stream type jet mill includes, for example, an impact type jet mill containing a venturi nozzle and an impact member arranged so as to face the venturi nozzle, and the like.

The process for pulverizing the pulverized product in the presence of the fine inorganic particles includes a process including the steps of previously mixing the roughly pulverized product with the fine inorganic particles before the fine pulverization, and feeding the mixture to a pulverizer; a process including the step of combining a roughly pulverized product or the toner composition with the fine inorganic particles upon feeding to a pulverizer and at the same time feeding the combination to the pulverizer; a process including the step of feeding the roughly pulverized product or the toner composition and the fine inorganic particles each from a separate feeding port to a pulverizer; and the like, without being particularly limited thereto. In the present invention, the process including the steps of previously mixing the roughly pulverized product and the fine inorganic particles having an average primary particle size of from 6 to 20 nm, and feeding the mixture to a pulverizer, from the viewpoint of adhesion of the fine inorganic particles.

The mixing of the roughly pulverized product and the fine inorganic particles can be carried, for example, with a mixer capable of agitating at a high speed, such as a Henschel mixer or a Super mixer. A Henschel mixer is preferable from the viewpoint of dispersibility.

When the above-mentioned mixer capable of agitating at a high speed is used, the time of mixing the roughly pulverized product and the fine inorganic particles is preferably from 1 to 5 minutes, and more preferably from 2 to 4 minutes.

The pulverized product according to the above process may be subjected to a classifier, from the viewpoint of removing fine powders according to a lower limit cut-off classification. Specific examples of the classifier preferably usable in the present invention include a classifier shown in FIG. 2 of JP-A-Hei-11-216425, a classifier shown in FIG. 6 of JP2004-78063 A, commercially available classifiers such as the "TSP" Series commercially available from Hosokawa Micron Corporation, and the like. As specific examples of the classifiers provided with a classifying rotor on each of two top and bottom stages, a classifier shown in FIG. 1 of JP2001-293438 A, commercially available classifiers such as the "TTSP" Series commercially available from Hosokawa Micron Corporation, and the like are preferable.

The mother toner particles obtainable by the above pulverizing steps have a volume-median particle size ($D_{50}$) of from 3 to 8 μm, and from the viewpoint of satisfying both fluidity and resolution, a volume-median particle size ($D_{50}$) of preferably from 3 to 7 μm, and more preferably from 4 to 6 μm. In the present specification, a volume-median particle size ($D_{50}$) of the mother toner particles is determined according to the method described in Examples set forth below.

In the step (2), the silica is externally added to the mother toner particles obtainable in the above step (1). As the process for externally adding the silica to the mother toner particles, a process including the step of mixing the silica and the mother toner particles with a mixer such as a Henschel mixer to externally add the silica to the toner surface.

It is desired that the silica has an average primary particle size of from 25 to 60 nm, preferably from 30 to 55 nm, and more preferably from 30 to 50 nm, from the viewpoint of securing durability of the toner. In the present specification, an average primary particle size of the silica is determined according to the method described in Examples set forth below.

The silica similarly includes those mentioned above, and those treated with a hydrophobic treatment agent is preferable. These can be used in admixture of two or more kinds. When two or more kinds of the silica are combined, it is preferable that an average primary particle size of all the silica to be combined is within the above range.

The silica is used in an amount of preferably from 0.5 to 4.0 parts by weight, more preferably from 1.0 to 4.0 parts by weight, and even more preferably from 1.0 to 3.0 parts by weight, based on 100 parts by weight of the mother toner particles, from the viewpoint of properly adjusting the BET specific surface area of the toner.

The weight ratio of the silica usable in the step (2) to the fine inorganic particles usable in the step (1) (silica/fine inorganic particles) is preferably from 0.1 to 0.8, more preferably from 0.1 to 0.7, and even more preferably from 0.2 to 0.6, from the viewpoint of properly adjusting the BET specific surface area of the toner.

Further, it is preferable that the toner of the present invention is obtainable by a process further including the step of externally adding the fine resin particles having an average primary particle size of from 50 to 500 nm to the mother toner particles at a point at least one of before, during, and after the step (2), from the viewpoint of improving transferability from a photoconductor to a printing medium.

As the fine resin particles, opposite charged fine resin particles to the silica used in the step (2) is preferable, from the viewpoint of improving adhesion of the silica usable in the step (2) to the toner surface by a triboelectric force. As the positively charged fine particles, melamine-formaldehyde fine particles, acrylic-based fine resin particles, and the like are preferable. As the negatively charged fine particles, polytetrafluoroethylene fine particles and the like are preferable.

The process for externally adding the fine resin particles to the mother toner particles similarly include the above-described process for externally adding the silica to the mother toner particles. The fine resin particles may be externally added to the mother toner particles at a point at least one of before, during, and after the step (2). In order to further improve adhesion of the silica by a triboelectric force of the fine resin particles, it is preferable that the resin fine particles are used together with the silica in the step (2), and it is preferable that the resin fine particles are externally added to the mother toner particles in parallel with the step (2).

The fine resin particles have an average primary particle size of preferably from 50 to 500 nm, more preferably from 100 to 400 nm, and even more preferably from 100 to 300 nm, from the viewpoint of adhesion to the toner and controlling the charging.

The fine resin particles are used in an amount of preferably from 0.01 to 1.0 parts by weight, more preferably from 0.05 to 0.7 parts by weight, and even more preferably from 0.1 to 0.5 parts by weight, based on 100 parts by weight of the mother toner particles obtainable in the step (1), from the viewpoint of the prevention of staining on a charging roller or the like.

The weight ratio of the silica usable in the step (2) to the fine resin particles (silica/fine resin particles) is preferably from 99/1 to 70/30, more preferably from 99/1 to 80/20, and even more preferably from 98/2 to 85/15, from the viewpoint of adjusting a balance of transferability and fluidity.

The toner of the present invention has a volume-median particle size ($D_{50}$) of preferably from 3 to 9 μm, more preferably from 3.5 to 9.0 μm, even more preferably from 4.0 to 7.5 μm, and even more preferably from 4.5 to 6.5 μm.

The toner of the present invention can be used without limitation in any of the development method, and can be either used as a toner for monocomponent development or as a toner for two-component development. Since the toner of the present invention is excellent in durability, the toner can be suitably used in a monocomponent developing method in which stress is high. In addition, the toner of the present invention has less free external additive, so that the toner can be suitably used for a color toner, especially, a full color toner.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Glass Transition Temperature of Resin]

The glass transition temperature refers to a temperature of an intersection of the extension of the baseline of equal to or lower than the temperature of the endothermic highest peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Value of Resin]

The acid value is determined by a method according to JIS K0070 except that only the determination solvent was changed from a mixed solvent of ethanol and ether as prescribed according to JIS K0070 to a mixed solvent of acetone and toluene (volume ratio of acetone:toluene=1:1).

[Melting Point of Releasing Agent]

The melting point refers to the maximum peak temperature for heat of fusion, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Volume-Median Particle Size ($D_{50}$) of Mother Toner Particles and Toner]

Measuring Apparatus: Coulter Multisizer II (commercially available from Beckman Coulter K.K.)

Aperture Diameter: 100 μm

Analyzing Software: Coulter Multisizer AccuComp Ver. 1.19 (commercially available from Beckman Coulter K.K.)

Electrolytic solution: "Isotone II" (commercially available from Beckman Coulter K.K.)

Dispersion: "EMULGEN 109P" (commercially available from Kao Corporation, polyoxyethylene lauryl ether, HLB: 13.6) is dissolved in the above electrolytic solution so as to have a concentration of 5% by weight, to give a dispersion.

Dispersion Conditions Ten milligrams of a test sample is added to 5 mL of the above dispersion, and the resulting mixture is dispersed in an ultrasonic disperser for 1 minute. Thereafter, 25 mL of the electrolytic solution is added to the dispersion, and the resulting mixture is dispersed in the ultrasonic disperser for another 1 minute, to give a sample dispersion.

Measurement Conditions The above sample dispersion is adjusted so as to have a concentration at which the particle sizes of 30,000 particles can be determined in 20 seconds by adding 100 mL of the above electrolytic solution to the above sample dispersion. Thereafter, the particle sizes of 30,000 particles are determined to obtain a volume-median particle size ($D_{50}$) from the particle size distribution.

[Average Primary Particle Size of Fine Inorganic Particles]

The average primary particle size refers to a number-average particle size and is calculated according to the following formula:

$$\text{Number-Average Particle Size(nm)}=6/(\rho\times\text{Specific Surface Area}(m^2/g))\times 1000,$$

wherein ρ is a true specific gravity of the fine inorganic particles, and the specific surface area is a BET specific surface area obtained by nitrogen absorption method of the fine inorganic particles. The true specific gravity of silica is 2.2, and the true specific gravity of titanium oxide is 4.2.

Supposing that the fine inorganic particles are spheres having a particle size of R, the above formula can be obtained by the following formulae:

$$\text{BET Specific Surface Area}=S\times(1/m)$$

$$m(\text{Weight of Particles})=\tfrac{4}{3}\times\pi\times(R/2)^3\times\text{Density}$$

$$S(\text{Surface Area})=4\pi(R/2)^2$$

Density referred here is the true specific gravity in the above formula.

[Average Primary Particle Size of Fine Resin Particles]

The average primary particle size refers to a number-average particle size.

For the number-average particle size, particle sizes (an average of a major axis and a minor axis) of one hundred particles are determined with a scanning electron microscope in proper imaging magnification from 5000 to 50000 times, and the average thereof is defined as an average primary particle size of the fine resin particles. Here, a major axis means a length of the longest axial direction in each of the particles, and a minor axis means a length of the shortest axial direction in the above particles.

[BET Specific Surface Area]

A BET specific surface area is determined by using a fluidized type automated measuring apparatus of specific surface area "FlowSorb III2305" (commercially available from Shimadzu Corporation). A mass of an empty sample cell W1 (g) is determined, and thereafter 0.1 g of a toner sample is supplied into a sample tube. The tube is placed in the main body of the apparatus, and degasfication is carried out under the conditions at the temperature of 40° C. and for the time period of 10 minutes. The sample cell is immersed in a Dewar tube filled with liquid nitrogen, and the value of adsorption (value of surface area of sample) A1 ($m^2$) is determined. Thereafter, the sample cell is immersed in water to change back the temperature to room temperature, and the value of desorption (value of surface area of sample) D1 ($m^2$) is determined. The sample cell is removed from the main body, and weight W3 (g) is determined. A BET specific surface area is calculated according to the formula: D1/(W3−W1) ($m^2$/g).

Production Example 1 for Resin

A 5 liter-four-necked flask equipped with a nitrogen inlet tube, a dehydration tube, a stirrer, and a thermocouple was charged with 1,286 g of polyoxypropylene(2.2)-2,2-bis(4-hydroxyphenyl)propane, 2,218 g of polyoxyethylene(2.2)-2,2-bis(4-hydroxyphenyl)propane, 1,603 g of terephthalic acid, and 10 g of tin octylate. The ingredients in the flask were reacted under a nitrogen atmosphere at 230° C. until a reaction rate reaches to 90%. Thereafter, the reaction mixture is further reacted at 8.3 kPa until the desired softening point was reached, to give a resin. The resulting resin had a softening point of 111.4° C., a glass transition temperature of 68.5° C., and an acid value of 3.2 mgKOH/g. The resulting resin is defined as polyester A. Here, the reaction rate is the value obtained by the formula: a generated amount of reacted water (mol)/a theoretical amount of generated water (mol)×100.

Production Example 2 for Resin

A 5 liter-four-necked flask equipped with a nitrogen inlet tube, a dehydration tube, a stirrer, and a thermocouple was charged with 3,308 g of polyoxypropylene(2.2)-2,2-bis(4-hydroxyphenyl)propane, 341 g of polyoxyethylene(2.2)-2,2-bis(4-hydroxyphenyl)propane, 792 g of fumaric acid, 5 g of hydroquinone, and 10 g of tin octylate. The ingredients in the flask were reacted under a nitrogen atmosphere while the temperature is raised from 180° C. to 230° C. for 5 hours, and the reaction mixture is then further reacted at 8.3 kPa for 1 hour. Thereafter, 480 g of trimellitic anhydride is supplied thereto, and the mixture is reacted for 1 hour under normal pressure. The reaction mixture is then further reacted at 8.3 kPa until the desired softening point was reached, to give a resin. The resulting resin had a softening point of 155.8° C., a glass transition temperature of 64.7° C., and an acid value of 33.2 mgKOH/g. The resulting resin is defined as polyester B.

Examples 1 to 3 and Comparative Examples 1 to 4

Seventy parts by weight of the polyester A, 30 parts by weight of the polyester B, 4.1 parts by weight of a colorant "Parmanent Carmine 3810" (commercially available from SANYO COLOR WORKS, LTD.), 2.7 parts by weight of a colorant "Super Magenta R" (commercially available from Dainippon Ink and Chemicals Incorporated), 3.5 parts by weight of a releasing agent "Carnauba Wax C1" (commercially available from Kato Yoko, melting point: 83° C.), 3.0 parts by weight of a releasing agent "HNP-9" (commercially available from Nippon Seiro, melting point: 79° C.), and 0.5 parts by weight of a charge control agent "LR-147" (commercially available from Japan Carlit) were mixed with a Henschel mixer. The mixture was kneaded with an open-roller type kneader (outer diameter: 320 mm, total length: 1800 mm, effective kneading length (L): 1500 mm, temperature at raw material feeding side of heat roller: 145° C., temperature at kneaded product discharging side of heat roller: 100° C., temperature at raw material feeding side of cooling roller: 85° C., temperature at kneaded product discharging side of cooling roller: 30° C., peripheral speed of heat roller: 70 m/min, peripheral speed of cooling roller: 50 m/min, gap between rollers: 0.1 mm). The resulting kneaded product was cooled in the air, and thereafter the cooled product was roughly pulverized with Alpine Rotoplex (commercially available from Hosokawa Micron Corporation), to give a roughly pulverized product (a toner composition) having a volume-median particle size ($D_{50}$) of 500 μm.

The fine inorganic particles shown in Table 2 were mixed with 100 parts by weight of the resulting roughly pulverized product with a Henschel mixer for 3 minutes. The resulting mixture was finely pulverized and classified by cutting off its upper limit with a counter jet mill "400AFG" (commercially available from Hosokawa Micron Corporation) at a raw material feeding rate of 30 kg/h, and a pulverization air pressure of 0.7 MPa, and the finely pulverized product was further classified by cutting off its lower limit with "TTSP" (commercially available from Hosokawa Micron Corporation), to give mother toner particles. For each of Example 1 and Comparative Examples 1 to 4, the silica and the fine resin particles shown in Table 2 were added to 100 parts by weight of the resulting mother toner particles, and for each of Examples 2 and 3, the silica shown in Table 2 was added to 100 parts by weight of the resulting mother toner particles, and each of the mixtures was mixed with a Henschel mixer for 3 minutes, to give a toner.

Here, the fine inorganic particles, the silica, and the fine resin particles used in each of Examples and each of Comparative Examples are as shown in the following Table 1.

TABLE 1

| | Manufacturer | Substance | Average Primary Particle Size (nm) | Chargeability | Hydrophobic Treatment Agent |
|---|---|---|---|---|---|
| R972 | Nippon Aerosil | Silica | 16 | Negative | Dimethyl Dichlorosilane |
| HVK2150 | Wacker Chemicals | Silica | 12 | Positive | Amino-Modified Silicone Oil |
| HDK H13TX | Wacker Chemicals | Silica | 16 | Negative | Hexamethyl Disilazane and Silicone Oil |
| TS530 | Cabot Corporation | Silica | 8 | Negative | Hexamethyl Disilazane |
| RX-50 | Nippon Aerosil | Silica | 40 | Negative | Hexamethyl Disilazane |
| RY-50 | Nippon Aerosil | Silica | 40 | Negative | Dimethyl Siloxane |
| EPOSTAR S | NIPPON SHOKUBAI CO., LTD. | Melamine-Formaldehyde Fine Particles | 200 | Positive | — |

Test Example 1 [Background Fog]

A toner of each of Examples and each of Comparative Examples was loaded to a nonmagnetic monocomponent development device "MicroLine 5400" (commercially available from Oki Data Corporation) containing an organic photoconductor (OPC). The loaded toner was then allowed to stand under an environment of 25° C./50% RH for 12 hours, and blank sheets (0%) were then printed. Thereafter, a toner remaining on a photoconductor drum was transferred to a mending tape, and the difference in image densities with the reference (a mending tape of which was not subjected to transferring operation) ΔE was determined with a colorimeter "X-Rite" (commercially available from X-Rite), and a background fog (NN background fog) was evaluated. Here, if the ΔE is less than 1.5, it shows that background fog is excellent. The results are shown in Table 2.

In addition, a toner was loaded to the same device as above, and the loaded toner was then allowed to stand under an environment of 35° C./80% RH for 12 hours. Thereafter, a background fog (HH background fog) was evaluated in the same manner as above. The results are shown in Table 2.

Test Example 2 [OPC Filming]

A toner was loaded to the same device as in Test Example 1, and a durability test was carried out at a printing rate of 5% under an environment of 25° C./50% RH. A solid image was printed on printing of every 1,000 sheets, and a white spot generated due to OPC filming was visually examined, to evaluate durability. The test was stopped at a point where the generation of a white spot was confirmed, and carried out for up to 12,000 sheets. When a white spot was not generated, it was evaluated as ○. When a white spot was generated up to 12,000 sheets, it was evaluated as X, and the number of the printed sheets at this point was recorded. The results are shown in Table 2.

TABLE 2

| | Fine Inorganic Particles Added at Step (1) (Parts by Weight Based on 100 Parts by Weight of Toner Composition) | | | | | Volume-Median Particle Size of Mother Toner Particles (μm) | Silica Externally Added at Step (2) (Parts by Weight Based on 100 Parts by Weight of Mother Toner Particles) | | | | |
|---|---|---|---|---|---|---|---|---|---|---|---|
| Ex. 1 | R972 (5.0) | HVK2150 (0.3) | HDK H13TX (1.2) | — | — | 5.2 | RY-50 (1.4) | RX-50 (0.3) | — | — | — |
| Ex. 2 | R972 (5.0) | HVK2150 (0.3) | HDK H13TX (1.2) | — | — | 5.3 | RY-50 (1.4) | RX-50 (0.3) | — | — | — |
| Ex. 3 | TS530 (6.0) | — | — | — | — | 5.2 | RY-50 (1.4) | RX-50 (0.3) | — | — | — |
| Comp. Ex. 1 | R972 (5.0) | HVK2150 (0.3) | HDK H13TX (1.2) | RY-50 (2.8) | RX-50 (0.6) | 5.2 | — | — | — | — | — |
| Comp. Ex. 2 | — | — | — | — | — | 5.3 | RY-50 (1.4) | RX-50 (0.3) | R972 (2.5) | HVK2150 (0.15) | HDK H13TX (0.6) |
| Comp. Ex. 3 | R972 (9.0) | HVK2150 (0.3) | HDK H13TX (1.2) | — | — | 5.2 | RY-50 (1.4) | RX-50 (0.3) | — | — | — |
| Comp. Ex. 4 | R972 (2.0) | — | — | — | — | 5.4 | RY-50 (0.7) | — | — | — | — |

| | | Physical Properties of Toner | | Evaluations of Toner | | |
|---|---|---|---|---|---|---|
| | Fine Resin Particles | Volume-Median Particle Size (μm) | BET ($m^2/g$) | OPC Filming | NN Background Fog | HH Background Fog |
| Ex. 1 | EPOSTAR S (0.3) | 5.2 | 2.5 | ○ | 0.5 | 0.8 |
| Ex. 2 | — | 5.3 | 2.6 | ○ | 0.6 | 1.0 |
| Ex. 3 | — | 5.2 | 3.2 | ○ | 0.5 | 1.3 |
| Comp. Ex. 1 | EPOSTAR S (0.3) | 5.2 | 2.5 | X (2000) | 0.5 | 0.9 |
| Comp. Ex. 2 | EPOSTAR S (0.3) | 5.3 | 4.2 | X (5000) | 0.9 | 4.1 |
| Comp. Ex. 3 | EPOSTAR S (0.3) | 5.2 | 4.0 | X (10000) | 0.8 | 1.5 |
| Comp. Ex. 4 | EPOSTAR S (0.3) | 5.4 | 1.4 | ○ | 0.5 | 5.5 |

It can be seen from the above results that the toners of Examples generate no background fog and reduce filming to OPC as compared to the toners of Comparative Examples. Specifically, the toner of Comparative Example 1 which was not subjected to the treatment of external addition with the silica at the step (2) was poor in filming, and the toner of Comparative Example 2 which was not subjected to a pulverization in the presence of the fine inorganic particles at the step (1) remarkably generated background fog under an environment of high-temperature and high-humidity. Here, it is considered that the reasons why BET specific surface areas of Comparative Examples 2 and 3 are larger than those of Examples are because Comparative Example 2 did not use the silica having a small particle size at the step (1), and because Comparative Example 3 uses a large amount of the silica having a small particle size.

The toner of the present invention is used for, for example, developing a latent image formed in electrophotography, electrostatic recording method, electrostatic printing method, or the like.

The present invention being thus described, it will be obvious that the same may be varied in ways. Such variations are not to be regarded as a departure from the spirit and scope of the invention, and all such modifications as would be obvious to one skilled in the art are intended to be included within the scope of the following claims.

What is claimed is:

1. A process for preparing a toner comprising the following steps (1) and (2);

step (1): pulverizing a toner composition comprising at least a resin binder and a colorant in the presence of silica having an average primary particle size of from 8 to 16 nm in an amount of from 6 to 6.5 parts by weight, based on 100 parts by weight of the composition, to obtain mother toner particles having a volume-median particle size of from 5.2 to 6 μm; and step (2): externally adding silica having an average primary particle size of from 30 to 50 nm in an amount of from 1.0 to 1.7 parts by weight, based on 100 parts by weight of the mother toner particles obtained in the above step (1).

2. The process according to claim 1, wherein the silica in the step (1) is a mixture of positively charged silica particles and negatively charged silica particles.

3. The process according to claim 2, wherein said toner is a positively charged toner and a weight ratio of said positively charged silica particles to said negatively charged silica particles is from 99/1 to 70/30.

4. The process according to claim 2, wherein said toner is a negatively charged toner and a weight ratio of said positively charged silica particles to said negatively charged silica particles is from 1/99 to 30/70.

5. The process according to claim 1, wherein the weight ratio of the silica in the step (2) to the silica in the step (1) (silica of step (2)/ silica of step (1)) is from 0.1 to 0.8.

6. The process according to claim 1, further comprising the step of externally adding the fine resin particles having an average primary particle size of from 50 to 500 nm to the mother toner particles at a point at least one of before, during, and after the step (2).

7. The process according to claim 1, wherein said toner has a BET specific surface are of from 1.5 to 3.5 $m^2/g$.

8. The process according to claim 1, wherein said toner has a BET specific surface are of from 1.8 to 3.5 $m^2/g$.

9. The process according to claim 1, wherein said toner has a BET specific surface are of from 2.0 to 3.0 $m^2/g$.

10. The process according to claim 7, wherein a surface of said silica of step (1) are subjected to hydrophobic treatment.

11. The process according to claim 1, wherein said binder resin is at least one resin selected from the group consisting of polyester, polyester amide, epoxy resin, polycarbonate polyurethane and styrene-acrylic resin.

12. The process according to claim 1, wherein step (1) is conducted in a jet type pulverizer.

* * * * *